United States Patent [19]

Breslow

[11] 4,039,191

[45] Aug. 2, 1977

[54] POOL TYPE GAME APPARATUS

[75] Inventor: Jeffrey D. Breslow, Highland Park, Ill.

[73] Assignee: Marvin Glass & Associates, Chicago, Ill.

[21] Appl. No.: 668,801

[22] Filed: Mar. 19, 1976

Related U.S. Application Data

[63] Continuation of Ser. No. 542,310, Jan. 20, 1975, abandoned.

[51] Int. Cl.[2] ..... A63F 7/00

[52] U.S. Cl. ..... 273/125 R; 273/127 R; 273/127 C

[58] Field of Search ..... 273/2, 12, 14, 41, 118 R, 273/118 A, 118 D, 119 R, 119 A, 119 B, 120 R, 120 A, 121 R, 121 A, 121 D, 121 E, 122 R, 122 A, 123 R, 123 A, 124 R, 124 A, 125 R, 125 A, 126 R, 126 A, 127 R, 127 C

[56] References Cited

U.S. PATENT DOCUMENTS

| | | | |
|---|---|---|---|
| 207,835 | 9/1878 | Witsil | 273/123 R |
| 235,209 | 12/1880 | Chambers | 273/41 |
| 379,174 | 3/1888 | Martin | 273/125 R |
| 652,880 | 7/1900 | Batdorf | 273/125 R |
| 657,522 | 9/1900 | Deiters et al. | 273/120 R |
| 738,625 | 9/1903 | McRuer | 273/119 R |
| 743,343 | 11/1903 | Sonne, Jr. | 273/123 R |
| 1,454,982 | 5/1923 | Pye | 273/119 R |
| 2,600,832 | 6/1952 | Benak | 273/118 A X |
| 3,464,699 | 9/1969 | Dollar | 273/127 R X |

*Primary Examiner*—Richard T. Stouffer
*Attorney, Agent, or Firm*—Mason, Kolehmainen, Rathburn & Wyss

[57] ABSTRACT

A pool type game apparatus which has a base structure having a playing surface over which balls or the like may be propelled, with bumper rails surrounding the playing surface. A ball receiving pocket is disposed generally centrally of the playing surface, and a cue stick or other ball propelling device is provided. An arcuate blocking flange protrudes upwardly through the pocket and is selectively movable about a central axis for blocking only a part of the pocket to change the available angles of approach for successfully propelling a ball into the pocket. A polygonal mobile bumper device is positionable on and manually movable bodily over the playing surface to any desired position for directing a ball which is propelled thereagainst, away therefrom at an angle defined by the straight side bumper surfaces of the mobile bumper device.

8 Claims, 5 Drawing Figures

POOL TYPE GAME APPARATUS

CROSS REFERENCE TO OTHER APPLICATIONS

This is a continuation of application Ser. No. 542,310, filed Jan. 20, 1975, now abandoned.

BACKGROUND AND SUMMARY OF THE INVENTION

This invention relates generally to pool type games, and in particular to a pool type game apparatus having a novel ball receiving pocket and a novel bumper means.

Pool type game apparatus have been known and enjoyed for many years, and normally include a playing surface over which one or more balls are propelled by cue sticks or spring plunger type ball propelling devices. One or more pockets are provided either about the bumper rail means surrounding the playing surface or spaced inwardly from the rail means so as to have a 360° range of approach for a ball to the pocket. In some instances, obstacles are provided in the form of stationary bumpers or posts protruding upwardly at desired locations on the playing surface. Such stationary bumpers not only provide obstacles but provide means off of which a ball may be caromed into a ball receiving pocket. It has been known to provide such stationary bumpers which have flat side bumper surfaces and the bumpers are selectively rotatable about a vertical axis to change the angular orientation of the bumper surfaces.

The present invention is directed to providing a new and improved pool type game apparatus which not only includes a novel bumper device selectively movable about the playing surface, but a means for selectively blocking a portion of a ball receiving pocket so as to change the possible angle of approach for successfully propelling a ball into the pocket.

In accordance with the invention, a base structure is provided having a playing surface over which balls or the like may be propelled. Bumper rails substantially surround the playing surface and a single ball receiving pocket is disposed generally centrally of the playing surface. Of course, plural pockets are within the scope of the present invention. A triangularly shaped mobile bumper device is positionable on and selectively movable bodily over the playing surface to any desired position thereon, the mobile bumper device having peripheral side bumper surfaces for directing a ball which is propelled thereagainst, away therefrom at an angle defined by the bumper surfaces. A ball propelling device in the form of a cue stick is provided for propelling balls over the playing surface into contact with other balls, the surrounding rail means, or the mobile bumper device in an attempt to propel a ball into the pocket.

In the exemplary embodiment, the mobile bumper device is triangularly shaped so as to provide three strsight side bumper surfaces. The bumper surfaces are defined by a post at each of the three corners of the triangle and a resilient bank wrapped about and spanning the three posts. In addition, an upright blocking device is selectively movable about the periphery of the central pocket for blocking only a part of the pocket to thereby change the possible angle of approach for a ball to be propelled into the pocket. In the exemplary embodiment, the pocket is circular and a semi- circular upright flange is pivotally mounted below the playing surface and extends upwardly through the pocket for rotational movement about the inner periphery of the pocket.

Other objects, features and advantages of the invention will be apparent from the following detailed description taken in connection with the accompanying drawings.

DETAILED DESCRIPTION OF THE INVENTION

Figure 1:
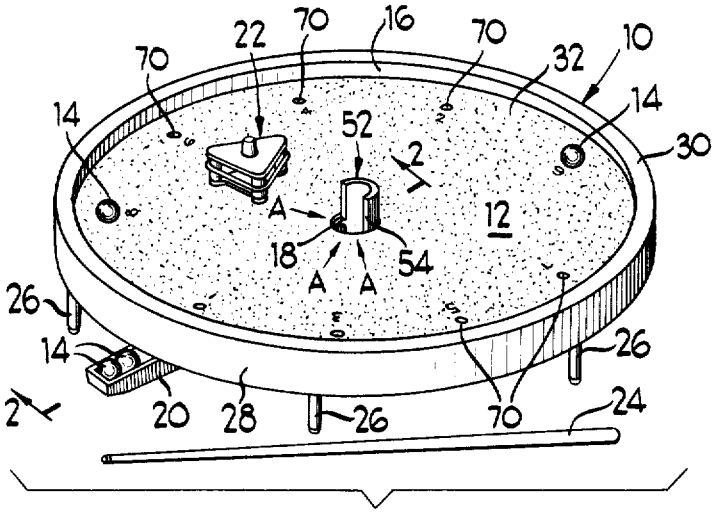
FIG. 1 is a perspective view of the pool type game apparatus of the present invention, along with a cue stick type ball propelling device.

Referring to the drawings in greater detail, the pool type game apparatus of the present invention is shown in perspective in FIG. 1 and includes a base or frame structure, generally designated 10, having a playing surface 12 over which balls 14 or the like may be propelled. Bumper rail means 16 surrounds the playing surface 12 and a centrally located ball receiving pocket 18 is provided through the playing surface and leads to an inclined trough or return ramp 20 whicch returns the ball to a position at one side of the base structure, as best seen in FIG. 1. A mobile bumper device, generally designated 22, is positionable on and selectively movable bodily over the playing surface to any desired position thereon, and a cue stick type ball propelling device is provided for propelling balls over the playing surface 12 into contact with other balls 14, the surrounding rail means 16, or the mobile bumper device 22 in an attempt to propel a ball into the pocket 18.

Figure 2:
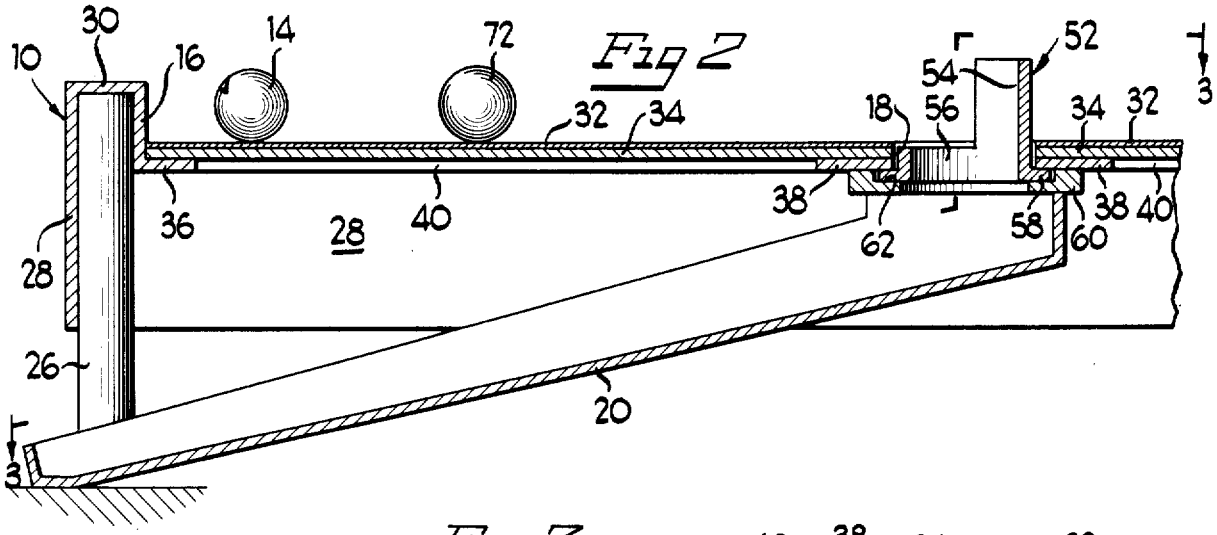
FIG. 2 is a vertical section, on an enlarged scale, taken generally along the line 2—2 of FIG. 1.
Figure 3:
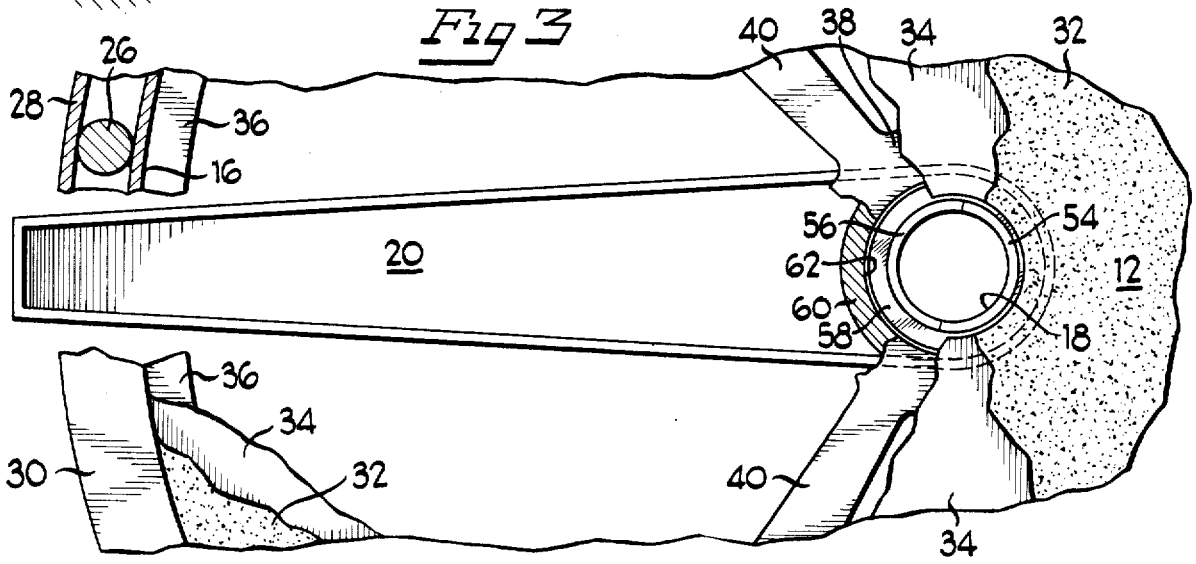
FIG. 3 is a horizontal section taken generally along the line 3—3 of FIG. 2, with various parts of the playing surface and frame structure broken away to facilitate the illustration.

Although the base structure 10 and playing surface 12 are shown circular in FIG. 1, it is to be understood that any other configuration such as square, rectangular, other polygonal or even irregular playing surfaces are contemplated and are within the scope of the present invention. In addition, many other ball propelling devices besides the cue stick type 24 shown in FIG. 1, such as spring plunger devices, are contemplated by the present invention. Further, the game apparatus is shown in FIGS. 1 and 2 as being supported by relatively short legs 26 which, is this instance, can be positionable on top of a table or the like. However, it is contemplated that the game apparatus could be the full standard height supported by considerably longer legs or other support means. Turning to FIG. 2, the base structure 10 is shown as a unitarily molded construction having an outside downwardly depending circular flange 28 formed integrally with a top horizontal annular lip 30 which is formed integrally with a second, shorter downwardly depending circular flange which defines the bumper rail means 16. The playing surface 12 is defined by a top layer 32 of felt or other friction material, a center layer 34 of rigid material such as Masonite or other appropriate material, and rigid support means therebeneath formed integrally with the base structure. More particularly, the support means includes a horizontal directed annular flange 36 formed at the lower edge of the bumper rail flange 16, a central circular flange 38 forming the pocket 18, and a plurality of spoke-like supporting webs 40 radially connecting the support flanges 36 and 38 on top of which is disposed the rigid central layer 34. Of course, proximate holes are cut in the layers 32 and 34 at the pocket 18.

Figure 4:
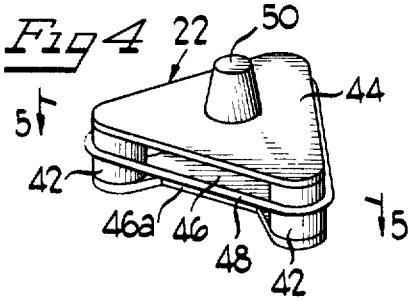
FIG. 4 is a perspective view of the mobile bumper device shown on top of the playing surface in FIG. 1.
Figure 5:
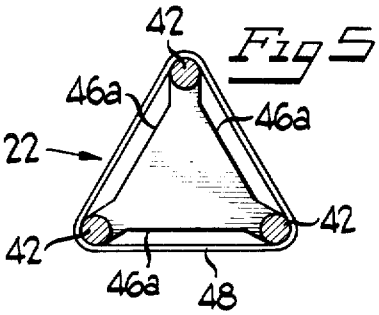
FIG. 5 is a horizontal section taken generally along the line 5—5 of FIG. 4.

Turning now to FIGS. 1, 4 and 5, the mobile bumper device 22 is shown in a triangular configuration. Of course, other configurations are contemplated by the present invention to provide plural side bumper surfaces as well as even a round configuration which is selectively manually movable bodily over the playing surface, although the straight side bumper surfaces provide a more positive or predictable propelling angle for the balls. The triangular mobile bumper device is formed by three corner posts 42 which are sandwiched between an upper triangular plate 44 and a lower generally triangular plate 46 which is recessed on its three sides 46a as seen best in FIG. 5. A resilient band 48, such as rubber material or the like, is wrapped about and spans the three posts 42. A handle knob 50 is provided on top of the upper plate 44 to facilitate manually moving the mobile bumper device about the playing surface.

It should be pointed out that the relative weights between the balls 14 and the overall mobile bumper device 22 should be given consideration so that the bumper device effectively and positively propels a ball therefrom. In practice, a substantial portion of the mobile bumper device has been fabricated of metal, at least the post portions 42 thereof. This would accommodate balls somewhat smaller or lighter than a standard billiard ball. However, a heavy leaded device could be utilized for use with a standard ball. In addition, it is preferable to provide a type of friction surface on the underside of the lower plate 46, but which would not damage the felt layer 32.

Thus, it can be seen that the mobile bumper device may be manually moved by a player of the game to a particular position so that the player can propel a ball thereagainst and have the ball propelled therefrom toward the pocket 18. This is particularly true in the present invention where a novel blocking means, generally designated 52 (FIGS. 1 and 2), is provided and is selectively movable for blocking a portion of the pocket 18 to change the possible angle of approach to the pocket for successfully propelling a ball 14 into the pocket.

More particularly, a semi-circular upright flange 54 is pivotally mounted by means below the playing surface whereby the flange 54 extends upwardly through the pocket for movement about the inside periphery thereof to block a portion (in this instance one-half) of the access to the pocket. The flange 54 actually is an upward protrusion of a short cylindrical member 56 (FIG. 2) disposed within the pocket 18. The cylindrical member is mounted by means of an integral radially extending peripheral flange 58 at the bottom of the member 56 which protrudes into and is received by a ring member 60 which is L-shaped so as to provide a recess 62 for receiving the flange 58. In this manner, the blocking means 52 (i.e., the upright semi-circular flange 54) is pivotable within the member 60 about an axis generally centrally of the pocket 18. Thus, it can be seen that half of the pocket 18 can be blocked at any selective angle by the outer concave surface of the flange 54. In other words, looking at FIG. 1, a ball would have to be propelled generally in the direction of arrows A in order to successfully roll into the pocket 18 whereupon it is returned by the inclined ramp 20. The mobile bumper device 22 can be expeditiously used particularly when a ball resides on the side of the pocket facing the concave side of the flange 54. The mobile bumper device can be moved by a player in position so that a ball can glance off of one of the sides of the device toward the open side of the pocket.

There are various schemes for playing the pool game apparatus of the present invention. In the exemplary embodiment, a plurality of starting positions 70 (FIG. 1) are defined on the playing surface 12 equally spaced and angularly about the pocket 18 adjacent the outer bumper rail means 16. As shown, there are nine starting positions, and consequently nine balls 14 are utilized. In addition, a cue ball 72 (FIG. 2) is utilized with the cue stick 24 in conventional manner. Of course, any number of starting positions is contemplated. One means of scoring would be that the winning player is that player propelling the most number of balls into the pocket 18. An alternate means of scoring would be to number the starting positions 1 through 9 in arbitrary fashion as shown in FIG. 1 and complementarily numbering the balls 14 so that the winning player is the player having the highest score as indicated by the numbers on the balls be propels into the pocket 18.

In utilizing the mobile bumper device 22 and selectively movable pocket blocking means 52, the game begins by the players deciding by chance or otherwise which player is to proceed first. That first player then positions the mobile bumper device 22 at a selected position on the playing surface 12 as he judges to be the best position to propel the most balls into the pocket 18 during his turn. The mobile ball propelling device remains in that position during the player's turn which terminates when the player first "misses" the pocket. During his turn, that player is entitled to selectively rotate the pocket blocking means 52, at will as he sees to his best advantage. Once the player first misses propelling a ball into the pocket 18, his turn is over and the next player is entitled to reposition the mobile bumper device 22 to his advantage, whereupon he proceeds to "shoot" while at all times being free to rotate the pocket blocking means 52.

A reverse scheme of play would be to require a player during his turn to initially fix the position of the rotatable pocket blocking means 52 and thereafter be permitted to freely move the mobile bumper means 22 during his turn (without moving the blocking means) until his turn is terminated. Of course, it is readily apparent that many other schemes or ramifications of play can be devised.

The foregoing detailed description has been given for clearness of understanding only and no unnecessary limitations should be understood therefrom as some mofifications will be obvious to those skilled in the art.

I claim:

1. A pool type game apparatus, comprising: a base structure having a playing surface over which balls or the like may be propelled, bumper rail means substantially surrounding the playing surface, at least one ball receiving pocket disposed at a selected position in the playing surface, a ball propelling device for propelling balls over said playing surface away from the propelling device into contact with other balls or the rail means in an attempt to propel a ball into said pocket.

and upright blocking means pivotally mounted to said base structure through said pocket for selective movement about the periphery of said pocket for blocking only a part of the pocket so that the angle of approach of a ball to be received in the pocket can be selectively changed.

2. The game apparatus of claim 1 wherein said pocket is spaced inwardly of said bumper rail means so as to have a possible 360° range of approach thereto.

3. The game apparatus of claim 2 wherein said blocking means includes an upstanding flange extending only partially about the periphery of said pocket, and including means pivotally mounting said flange for movement about an axis generally centrally of said pocket.

4. The game apparatus of claim 3 wherein said upstanding flange is arcuate in shape, with the concave side thereof facing outwardly of the pocket.

5. A pool type game apparatus, comprising: a base structure having a playing surface over which balls or the like may be propelled, bumper rail means substantially surrounding the playing surface, at least one ball receiving pocket disposed at a selected position in the playing surface, a mobile bumper device positionable on and selectively movable bodily over the playing surface to any desired position thereon, said mobile bumper device being polygonal in configuration so as to define peripheral side bumper surfaces including a plurality of upright posts one at each corner of the polygon with a resilient band wrapped about and spanning the posts for deflecting a ball which is propelled thereagainst, and a ball propelling device for propelling balls over said playing surface away from the propelling device into contact with other balls, the rail means, or said mobile bumper device in an attempt to propel a ball into said pocket.

6. A pool type game apparatus, comprising: a base structure having a playing surface over which balls or the like may be propelled, bumper rail means substantially surrounding the playing surface, at least one ball receiving pocket spaced inwardly of said bumper rail means so as to have a possible 360° range of approach thereto, a ball propelling device for propelling balls over said playing surface away from the propelling device into contact with other balls or the rail means in an attempt to propel a ball into said pocket, and upright blocking means selectively movable about the periphery of said pocket for blocking only a part of the pocket so that the angle of approach of a ball to be received in the pocket can be selectively changed, said blocking means comprising an arcuately shaped upstanding flange pivotally mounted to the base structure and extending upwardly through the pocket about the periphery thereof on an axis generally centrally thereof with the concave side of the arcuate flange facing outwardly of the pocket.

7. A pool type game apparatus, comprising: a base structure having a playing surface over which balls or the like may be propelled, bumper rail means substantially surrounding the playing surface, at least one ball receiving pocket disposed at a selected position in the playing surface, a ball propelling device for propelling balls over said playing surface away from the propelling device into contact with other balls or the rail means in an attempt to propel a ball into said pocket, upright blocking means selectively movable about the periphery of said pocket for blocking only a part of the pocket so that the angle of approach of a ball to be received in the pocket can be selectively changed, and a mobile bumper device positionable on and selctively movable bodily over the playing surface to any desired position thereon, said mobile bumper device being polygonal in configuration so as to present plural straight side bumper surfaces for directing a ball which is propelled thereagainst, away therefrom at an angle defined by said bumper surfaces.

8. A pool type game apparatus, comprising: a base structure having a playing surface over which balls or the like may be propelled, bumper rail means substantially surrounding the playing surface, at least one ball receiving pocket disposed at a selected position in the playing surface, a mobile bumper device positionable on and selectively movable bodily in any direction over the playing surface for placement at any desired position thereon, said mobile bumper device being polygonal in configuration so as to present plural straight side bumper surfaces for directing a ball which is propelled thereagainst, away therefrom at an angle defined by said bumper surfaces, a plurality of upright members at the corners of the polygon with resilient means wrapped about and spanning the upright members for deflecting a ball which is propelled thereagainst, and a ball propelling device for propelling balls over said playing surface away from the propelling device into contact with other balls, the rail means, or said mobile bumper device in an attempt to propel a ball into said pocket.

* * * * *